US009521941B2

(12) United States Patent
Dickey et al.

(10) Patent No.: US 9,521,941 B2
(45) Date of Patent: Dec. 20, 2016

(54) WAREWASH MACHINE CHEMICAL SENSOR AND RELATED SYSTEM AND METHOD

(71) Applicants: Larry M. Dickey, Kettering, OH (US); David L. Fischer, Fairborn, OH (US); Jeffrey R. Newcomer, Troy, OH (US); Michael T. Watson, Beavercreek, OH (US); Brian R. Prybor, Kettering, OH (US); Alexander R. Anim-Mensah, Centerville, OH (US)

(72) Inventors: Larry M. Dickey, Kettering, OH (US); David L. Fischer, Fairborn, OH (US); Jeffrey R. Newcomer, Troy, OH (US); Michael T. Watson, Beavercreek, OH (US); Brian R. Prybor, Kettering, OH (US); Alexander R. Anim-Mensah, Centerville, OH (US)

(73) Assignee: PREMARK FEG L.L.C., Glenview, IL (US)

( * ) Notice: Subject to any disclaimer, the term of this patent is extended or adjusted under 35 U.S.C. 154(b) by 807 days.

(21) Appl. No.: 13/826,480

(22) Filed: Mar. 14, 2013

(65) Prior Publication Data

US 2014/0053881 A1 Feb. 27, 2014

Related U.S. Application Data

(60) Provisional application No. 61/691,581, filed on Aug. 21, 2012.

(51) Int. Cl.

| | |
|---|---|
| ***A47L 15/44*** | (2006.01) |
| ***A47L 15/42*** | (2006.01) |
| ***A47L 15/00*** | (2006.01) |

(52) U.S. Cl.

CPC ..... *A47L 15/4236* (2013.01); *A47L 15/0055* (2013.01); *A47L 15/4297* (2013.01);
(Continued)

(58) Field of Classification Search

CPC ..... A47L 15/4297

See application file for complete search history.

(56) References Cited

U.S. PATENT DOCUMENTS

| | | | |
|---|---|---|---|
| 3,897,798 | A | 8/1975 | De Vale |
| 3,939,360 | A | 2/1976 | Jackson |

(Continued)

FOREIGN PATENT DOCUMENTS

| | | | |
|---|---|---|---|
| CN | 1274076 | A | 11/2000 |
| CN | 1553286 | A | 12/2004 |

(Continued)

OTHER PUBLICATIONS

English machine translation of JP2000-170663.*

(Continued)

*Primary Examiner* — Michael Barr
*Assistant Examiner* — Jason Riggleman
(74) *Attorney, Agent, or Firm* — Thompson Hine LLP

(57) ABSTRACT

A flow through chemical sensor includes a housing having a through passage along which chemical can flow, a sidewall of the housing having first and second openings that communicate with the through passage. A first electrode is mounted on the housing and aligned with the first opening, the first electrode of a plate configuration with a unitary depression that extends through the first opening and to a peripheral edge of the through passage. A second electrode is mounted on the housing and aligned with the second opening, the second electrode of a plate configuration with a unitary depression that extends through the second opening and to the peripheral edge of the through passage. A method of detecting presence or absence of chemical is also provided.

8 Claims, 7 Drawing Sheets

(52) U.S. Cl.
CPC ..... *A47L 15/4418* (2013.01); *A47L 2401/023* (2013.01); *A47L 2401/30* (2013.01); *A47L 2501/26* (2013.01)

(56) References Cited

U.S. PATENT DOCUMENTS

| | | | |
|---|---|---|---|
| 4,142,539 | A | 3/1979 | Shih et al. |
| 4,242,051 | A | 12/1980 | Mason et al. |
| 4,323,092 | A | 4/1982 | Zabel |
| 4,373,863 | A | 2/1983 | Mason et al. |
| 4,382,382 | A | 5/1983 | Wang |
| 4,509,543 | A | 4/1985 | Livingston et al. |
| 4,562,605 | A | 1/1986 | Quintarelli |
| 4,628,302 | A | 12/1986 | Barr et al. |
| 4,657,670 | A | 4/1987 | Newton |
| 4,733,798 | A | 3/1988 | Brady et al. |
| 4,751,842 | A | 6/1988 | Ekrann et al. |
| 4,756,321 | A | 7/1988 | Livingston et al. |
| 4,810,306 | A | 3/1989 | Noren |
| 4,867,193 | A | 9/1989 | Hayashi et al. |
| 4,872,466 | A | 10/1989 | Noren |
| 5,017,879 | A | 5/1991 | Lucas et al. |
| 5,017,909 | A | 5/1991 | Goekler |
| 5,027,075 | A | 6/1991 | Harding, Jr. |
| 5,038,807 | A | 8/1991 | Bailey et al. |
| 5,050,433 | A | 9/1991 | Lumetta |
| 5,056,542 | A | 10/1991 | Reinhard |
| 5,131,419 | A | 7/1992 | Roberts |
| 5,137,041 | A | 8/1992 | Hall |
| RE34,073 | E | 9/1992 | Suzuki |
| 5,150,062 | A | 9/1992 | Takeuchi |
| 5,176,297 | A | 1/1993 | Mooney et al. |
| 5,187,444 | A | 2/1993 | Kumada et al. |
| 5,202,582 | A | 4/1993 | Szynal et al. |
| 5,218,988 | A | 6/1993 | McNamara et al. |
| 5,220,514 | A | 6/1993 | John |
| 5,226,313 | A | 7/1993 | Murata et al. |
| 5,309,939 | A | 5/1994 | Stickel et al. |
| 5,378,993 | A | 1/1995 | Flask et al. |
| 5,438,323 | A | 8/1995 | Shea |
| 5,453,131 | A | 9/1995 | Chan et al. |
| 5,462,606 | A | 10/1995 | Burns |
| 5,493,922 | A | 2/1996 | Ramey et al. |
| 5,494,061 | A | 2/1996 | Chan et al. |
| 5,500,050 | A | 3/1996 | Chan et al. |
| 5,543,717 | A | 8/1996 | Kordas |
| 5,555,583 | A | 9/1996 | Berkcan |
| 5,560,060 | A | 10/1996 | Dausch et al. |
| 5,586,567 | A * | 12/1996 | Smith ..... A47L 15/4297 134/113 |
| 5,603,233 | A | 2/1997 | Erickson et al. |
| 5,611,867 | A | 3/1997 | Cooper et al. |
| 5,641,006 | A | 6/1997 | Autrey et al. |
| 5,647,391 | A | 7/1997 | Chan et al. |
| 5,792,276 | A | 8/1998 | Driessen |
| 5,806,541 | A | 9/1998 | Cooper et al. |
| 5,820,691 | A | 10/1998 | Hartman |
| 5,839,454 | A | 11/1998 | Matz |
| 6,035,472 | A | 3/2000 | Barbe |
| 6,055,831 | A | 5/2000 | Barbe |
| 6,092,541 | A | 7/2000 | Crane et al. |
| 6,223,129 | B1 | 4/2001 | Chan et al. |
| 6,338,760 | B1 | 1/2002 | Landaeus et al. |
| 6,918,398 | B2 | 7/2005 | Edelmann et al. |
| 2004/0160328 | A1 | 8/2004 | Becknell |

FOREIGN PATENT DOCUMENTS

| | | | |
|---|---|---|---|
| CN | 101453935 | A | 6/2009 |
| CN | 101821605 | A | 9/2010 |
| JP | 2000-170663 | * | 10/1998 |
| JP | 2000170663 | A | 6/2000 |
| WO | WO 03/054558 | A1 | 7/2003 |

OTHER PUBLICATIONS

International Searh Report and Written Report; mailed Apr. 10, 2014; PCT/US2013/053330; filed Aug. 2, 2013; 15 pgs.

Invitation to Pay Additional Fees and Partial International Search , mailed Oct. 7, 2013; PCT/US2013/053330; filed Aug. 2, 2013; 5 pgs.

* cited by examiner

WAREWASH MACHINE CHEMICAL SENSOR AND RELATED SYSTEM AND METHOD

CROSS-REFERENCES

This application claims the benefit of U.S. Provisional Application Ser. No. 61/691,581, filed Aug. 21, 2012, which is incorporated herein by reference.

TECHNICAL FIELD

This application relates generally to the field of warewash machines that utilize chemicals and, more specifically, to a chemical sensor, system and method for detecting the presence or absence of chemicals used for ware cleaning operations.

BACKGROUND

On a stationary warewasher or dishwasher (e.g., a batch-type or box-type dishwasher), wash arms located on the top and/or bottom of the washing chamber wash wares located in a dish rack by directing a washing solution out of nozzles located on the arms. The sprayed washing solution is typically a recirculated solution that, once sprayed, falls and collects in a sump below the chamber, is drawn from the sump through a strainer by a pump and is pushed by the pump along a flow path into the wash arms and then out through the nozzles. One or more rotatable rinse arms may also be provided for spraying fresh rinse liquid. In a flow-through warewasher (e.g., a continuous-type warewasher), wares are moved through a chamber (e.g., via a conveyor that moves racks of wares or via a conveyor with flights that hold wares) with multiple spray zones (e.g., a pre-wash zone, a wash zone, a post-wash or pre-rinse zone and a final rinse zone, each having respective nozzles) as they are cleaned.

Regardless of machine type, chemicals may be added to the wash and/or rinse liquid sprays during ware cleaning operations to increase the effectiveness of the operation. For example, detergent, sanitizer, rinse aid and/or deliming chemicals may be used in the warewash machine at various times. The chemicals are typically pumped from a storage container (e.g., a bottle or tank) at desired stages and in desired amounts. On a commercial warewasher, it is sometimes required and always advantageous to inform the machine operator when it is required to add additional chemicals to the supply bottles or tanks. The results for the end user will be the best when the operator knows precisely when the chemicals need to be replenished, therefore accurate and responsive sensing of the chemicals is the goal. Also, making the sensor work for multiple chemical brands/formulas is desirable.

SUMMARY

In one aspect, a warewash machine includes a chamber for receiving wares to be washer, the chamber including spray nozzles for spraying liquid. A first chemical flow path feeds a first chemical to the chamber (e.g. directly or indirectly), where the first chemical flow path includes a first flow through chemical sensor therealong. A second chemical flow path feeds a second chemical to the chamber (e.g., either directly or indirectly), the second chemical flow path including a second flow through chemical sensor therealong. The first flow through chemical sensor includes a first fluid passage therethrough and first and second electrodes thereon, the first and second electrodes in communication with the first fluid passage, the first and second electrodes arranged in a electrode parallel configuration. The second flow through chemical sensor includes a second fluid passage therethrough and third and fourth electrodes thereon, the third and fourth electrodes in communication with the second fluid passage, the third and fourth electrodes arranged in a electrode opposed configuration.

In one implementation of the foregoing aspect, the first chemical is one of detergent or sanitizer and the second chemical is a rinse aid.

The first chemical flow path may be connected to deliver the first chemical into a wash water recirculation path of the warewash machine, and the second chemical flow path may be connected to deliver the second chemical into a rinse line path of the warewash machine.

In one implementation according to any one of the three preceding paragraphs, the first flow through chemical sensor is oriented such that (i) an axis that runs parallel with an axial flow path of the first fluid passage is offset from both vertical and horizontal and (ii) the first and second electrodes are offset from both a top of the first fluid passage and a side of the first fluid passage; and the second flow through chemical sensor is oriented such that (i) an axis that runs parallel with an axial flow path of the second fluid passage is offset from both vertical and horizontal and (ii) the third and fourth electrodes are offset from both a top of the second fluid passage and a side of the second fluid passage.

In one implementation according to any one of the four preceding paragraphs, a distance between the first electrode and the second electrode along the first fluid passage is at least twice a distance between the third electrode and the fourth electrode across the second fluid passage.

In one implementation according to any one of the five preceding paragraphs, each of the first and second electrodes is of a plate configuration with a unitary depression that extends inward the first fluid passage; and each of the third and fourth electrodes is of a plate configuration with a unitary depression that extends inward the second fluid passage.

In another aspect, a flow through chemical sensor includes a housing having a through passage along which chemical can flow, a sidewall of the housing having first and second openings that communicate with the through passage. A first electrode is mounted on the housing and aligned with the first opening, the first electrode of a plate configuration with a unitary depression that extends through the first opening and to a peripheral edge of the through passage. A second electrode is mounted on the housing and aligned with the second opening, the second electrode of a plate configuration with a unitary depression that extends through the second opening and to the peripheral edge of the through passage.

In one implementation of the aspect of the preceding paragraph, a first o-ring is positioned between the housing and the first electrode and the first electrode is secured to the housing by way of a first fastener that provides a clamping force of the first electrode against the first o-ring for sealing, wherein the unitary depression of the first electrode extends through an opening of the first o-ring. Likewise, a second o-ring is positioned between the housing and the second electrode and the second electrode is secured to the housing by way of a second fastener that provides a clamping force of the second electrode against the second o-ring for sealing, wherein the unitary depression of the second electrode extends through an opening of the second o-ring.

The first electrode may include a first lead arm configured for connection with a wire terminal; and the second electrode may include a second lead arm configured for connection with a wire terminal.

In a warewash machine including the flow through chemical sensor of any one of the three preceding paragraphs, the flow through chemical sensor may be located in a chemical feed line for delivering chemical directly or indirectly to a chamber of the machine.

The flow through chemical sensor of the machine of the preceding paragraph may be connected in a chemical detection circuit of the machine via the first and second electrodes, where a controller of the machine is configured to apply a periodic excitation signal to the chemical detection circuit. The chemical detection circuit is configured so that the flow through chemical sensor attenuates the periodic excitation signal according to impedance level of the chemical such that a level of attenuation varies inversely with impedance of the chemical and the sensor causes little or no attenuation in the absence of the chemical. The controller may be further configured to evaluate the attenuated signal to determine the presence or absence of chemical and, in the absence of chemical to produce an operator alert.

Where the warewash machine of any one of the two preceding paragraphs includes a user interface that enables an operator to identify the chemical being used, the controller may be configured to automatically define a frequency of the applied periodic excitation signal according to operator selection of the chemical being used.

In a further aspect, a method of detecting presence or absence of a chemical in a chemical feed line of a warewash machine is provided, where the method includes the steps of: providing a flow through sensor in the chemical feed line, the sensor including a through passage and a pair of electrodes in communication with the through passage, the sensor connected in a chemical detection circuit via the pair of electrodes; applying a periodic excitation signal to the chemical detection circuit; the sensor attenuating the periodic excitation signal according to impedance level of the chemical such that a level of attenuation varies inversely with impedance of the chemical and the sensor causing little or no attenuation in the absence of the chemical; and evaluating the attenuated excitation signal to determine the presence or absence of chemical.

The evaluating step may involve converting the attenuated excitation signal to a DC voltage, and evaluating the DC voltage to determine the presence or absence of chemical.

The periodic excitation signal may be a square wave signal and the evaluating step may involve comparing the DC voltage to a set threshold.

The method may including the further steps of: defining a frequency of the periodic excitation signal according to one or more properties of the chemical and/or defining the set threshold according to one or more properties of the chemical.

In one implementation, the warewash machine includes a user interface that enables an operator to identify the chemical being used and the warewash machine automatically defines the frequency and/or defines the set threshold according to operator selection of the chemical being used.

In such implementation the warewash machine may include a controller storing multiple chemical types and, for each chemical type, a corresponding excitation signal frequency and/or set threshold.

The details of one or more embodiments are set forth in the accompanying drawings and the description below. Other features, objects, and advantages will be apparent from the description and drawings, and from the claims.

DETAILED DESCRIPTION

Figure 1:
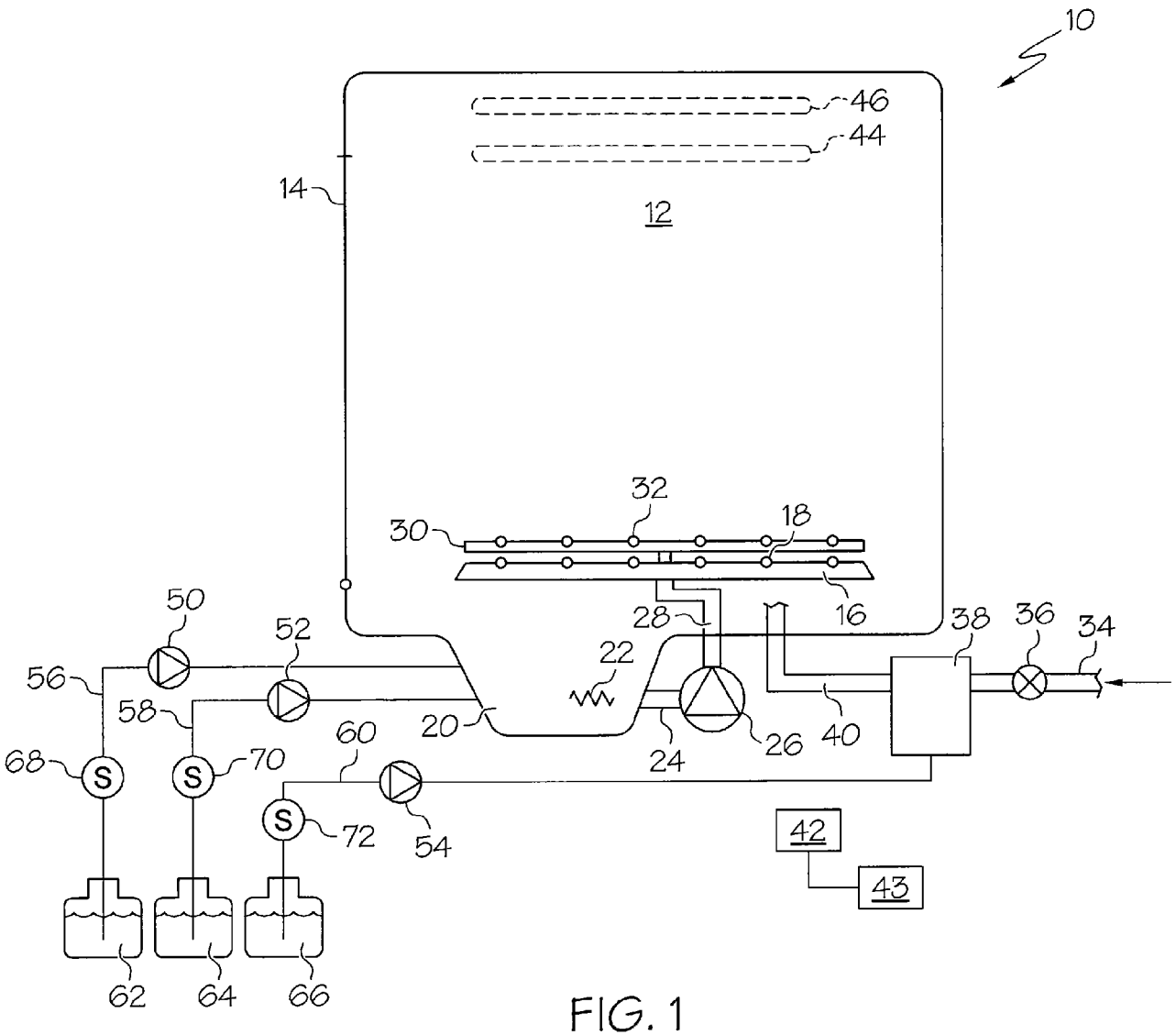
FIG. 1 is schematic depiction of a batch-type warewasher.
Figure 7:
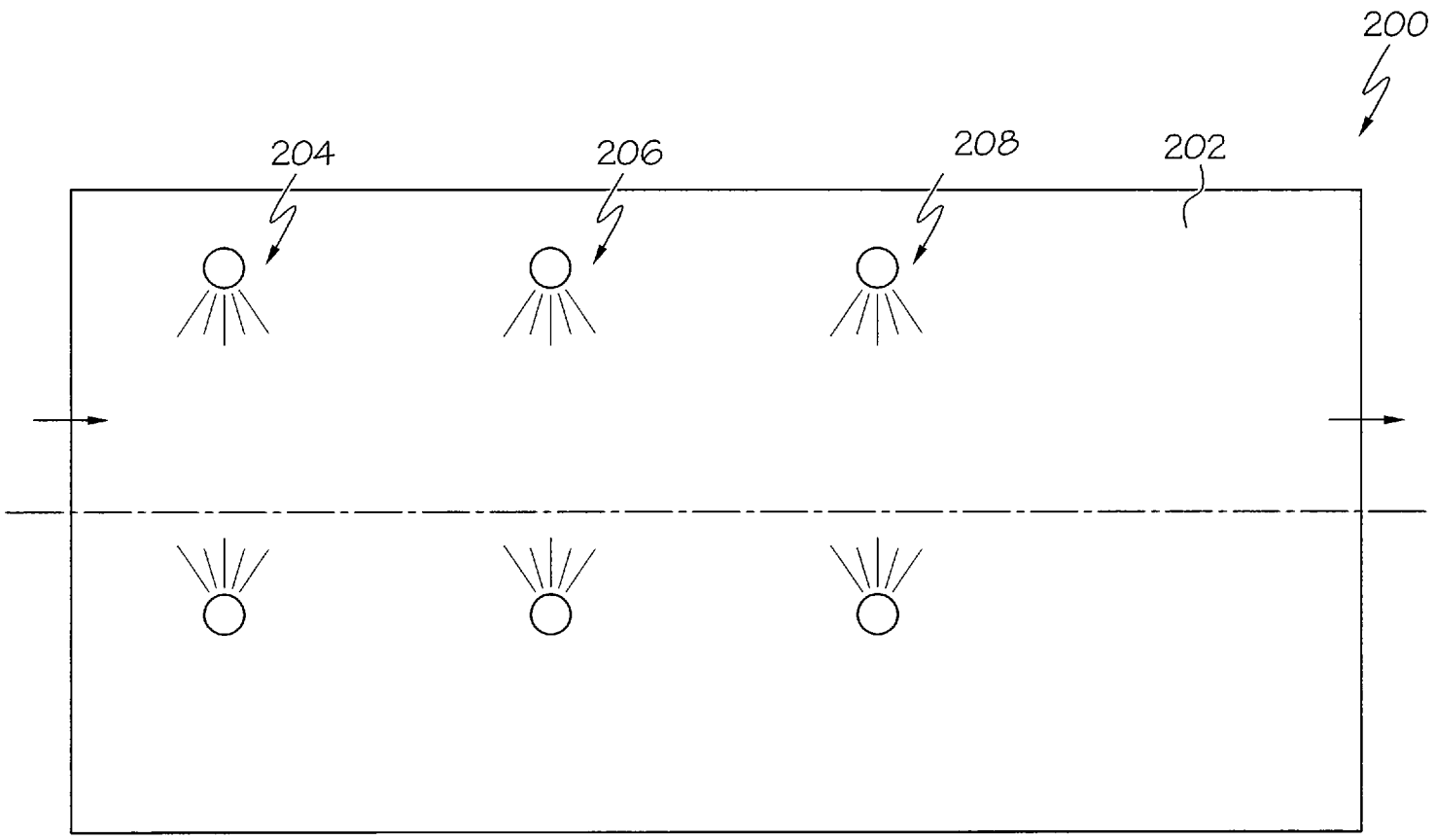
FIG. 7 is a schematic side elevation of a flow-through type warewash machine.

Referring to FIG. 1, a schematic depiction of a batch-type warewasher 10 is shown, and includes a chamber 12 in which wares are placed for cleaning via opening of a pivoting access door 14. At the bottom of the chamber 12, a rotatable wash arm 16 is provided and includes multiple nozzles 18 that eject wash liquid during a cleaning operation. The wash liquid contacts the wares for cleaning and then falls back down into a collection sump 20 that may include a heater element 22. A recirculation path is provided via piping 24, pump 26 and piping 28 to move the wash liquid back to the wash arm 16. A rotatable rinse arm 30 with nozzles 32 is also shown, to which fresh rinsing liquid may be fed via a rinse line made up of fresh water input line 34, valve 36, boiler 38 and line 40. A controller 42 is also shown, which may typically be programmed to carry out one or more selectable ware cleaning cycles that generally each include at least a washing step (e.g., that may run for 30-150 seconds, followed by a rinsing step (e.g., that may run for 10-30 seconds), though many other variations are possible. A user interface 43 is also associated with the controller for enabling operator selection of a ware cleaning cycle, etc. Although the illustrated machine 10 includes only lower arms, such machines may also include upper wash and rinse arms shown schematically as 44 and 46. Such machines may also include other features, such as blowers for a drying step at the end of a ware cleaning cycle. Machines with hood type doors, as opposed to the illustrated pivoting door, are also known. And flow-through machines are also known as suggested above. For example, FIG. 7 schematically depicts a flow-through type machine 200 with a housing that defines an internal chamber 202 that includes multiple spray zones 204, 206 and 208, with a conveyor 210 to carry the wares through the zones for cleaning.

As shown in FIG. 1, the system includes a set of pumps 50, 52, 54 along respective feed lines 56, 58, 60 to deliver chemicals from supply bottles 62, 64, 66. By way of example, bottles 62 and 64 may hold detergent and sanitizer respectively, which are selectively delivered into the machine sump 20, and bottle 66 may hold rinse aid that is selectively delivered into the boiler 38. Each feed line 56, 58 and 60 includes a respective in-line chemical sensor 68, 70, 72 to detect whether chemical is passing along the feed line when the pump 50, 52, 54 is operating. The in-line chemical sensors have an advantageous configuration described in more detail below. Feed lines 56 and 58 (e.g., for detergent and sanitizer respectively) are shown delivering chemical directly to the sump 20, but could alternatively be connected to feed chemical elsewhere in the chamber 12 or to a portion of the recirculation path 24, 26, 28. Feed line 60 (e.g., for rinse aid) is shown delivering the rinse aid directly to the hot water booster 38, but could alternatively deliver the rinse aid elsewhere into the rinse line, either upstream or downstream of the booster. While three chemical sensors are shown in FIG. 1, it is recognized that the number of sensors could be varied according to the number or chemicals and chemical feed lines used in any particular machine. For example, a delime chemical feed line with a corresponding chemical sensor could also be included. Similar chemical feed systems and sensors could be associated with the one or more of the spray zones of the machine of FIG. 7.

Figure 2A:
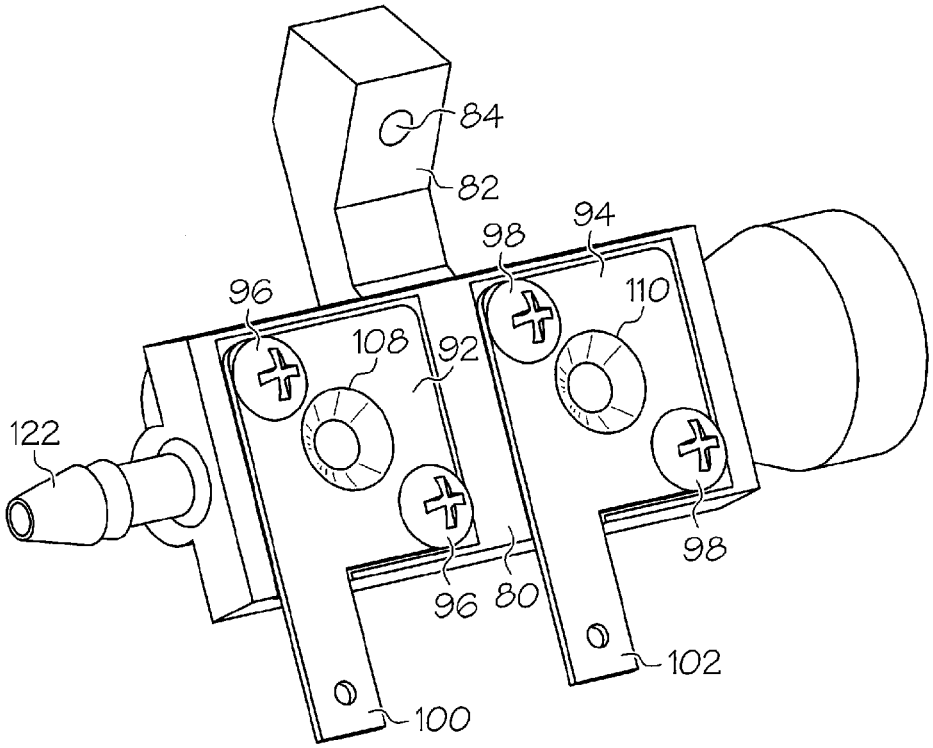
FIGS. 2A and 2B show one sensor arrangement.
Figure 2B:
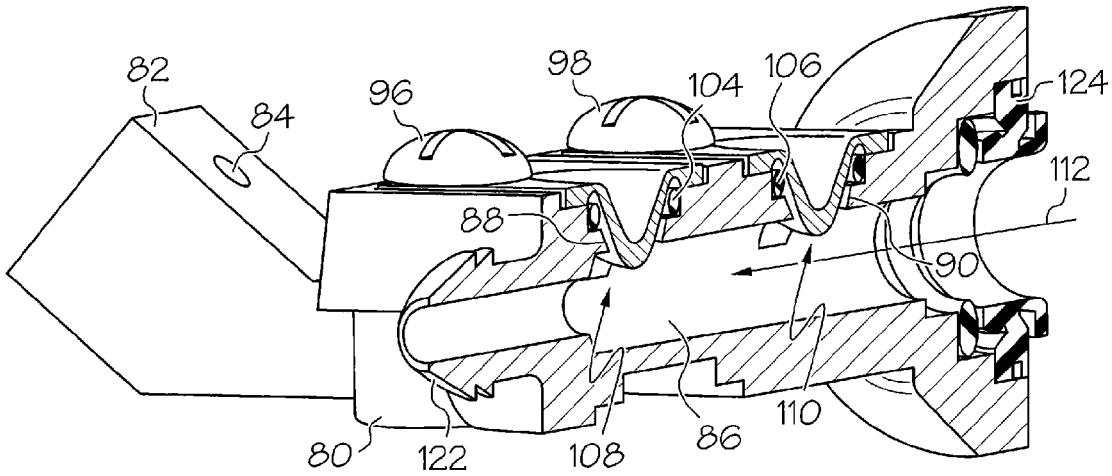

Referring now to FIGS. 2A and 2B, one arrangement of a chemical sensor is shown. The chemical sensor includes a housing 80 with a unitary mount arm or post 82 having an opening 84 through which a fastener may be passed for mounting the housing within the warewash machine. The housing also includes a through passage 86 along which chemical can flow. The housing may be of a polypropylene or other plastic material, and formed as a molded body having open sidewall areas 88, 90 that allow the mounting of respective electrodes 92, 94, such as by fasteners 96, 98 (e.g., screws) threaded into the housing 80. The electrodes 92, 94 are made of a conductive material that is chemically resistant to the chemical that is being sensed, which material may be previously subjected to a passivation process for such purpose. Notably, the electrodes 92, 94 have protruding lead ends 100, 102 that are configured to enable a wire to be directly connected to the sensor with a wire terminal. The electrode mount configuration also effectively seals the open areas 88, 90 through the use of o-rings 104, 106 between the electrode and the housing and to which pressure is applied (e.g., to provide o-ring compression) through a clamping load provided by the fasteners 96, 98. The electrodes are also shaped with an embossment or unitary depression 108, 110 (e.g., as formed by a stamping operation) that extends deep enough into the tubular passage 86 so that chemical is in direct contact with the embossments when the passage 86 is full of chemical during a chemical pump operation. The sensor arrangement shown in FIGS. 2A and 2B represents a configuration that may be considered or called an electrode parallel configuration in that the electrodes 92, 94 are positioned side by side each other on the housing and the path of electrical contact between the two electrodes runs generally parallel to the flow direction 112 of chemical through passage 86. As used herein, the term "unitary" when referring to a portion of a component means that the portion of the component is formed commonly with the component rather than being formed separately and then attached to the component.

Figure 3A:
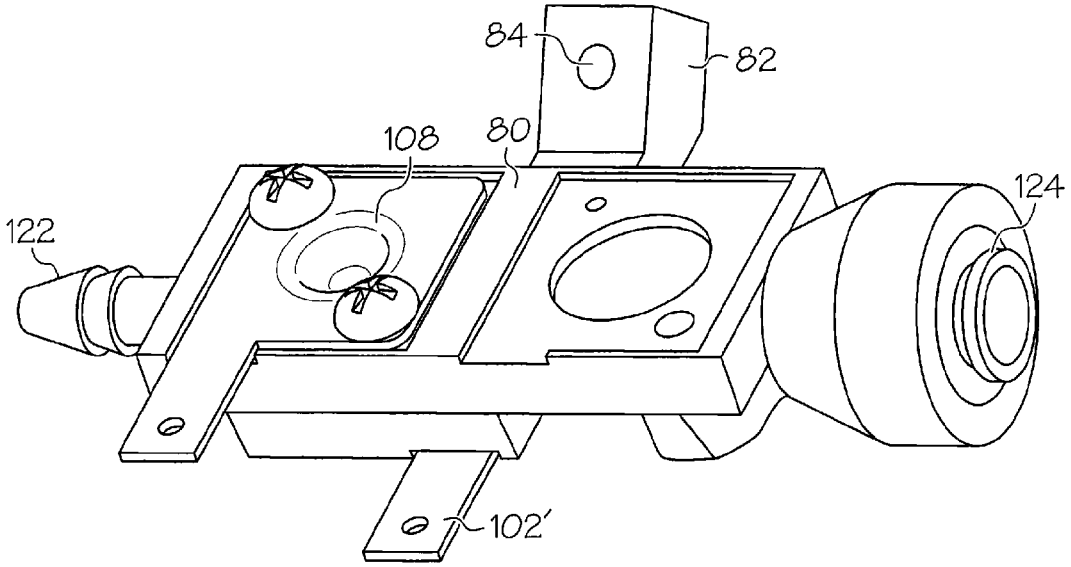
FIGS. 3A and 3B show another sensor arrangement.
Figure 3B:
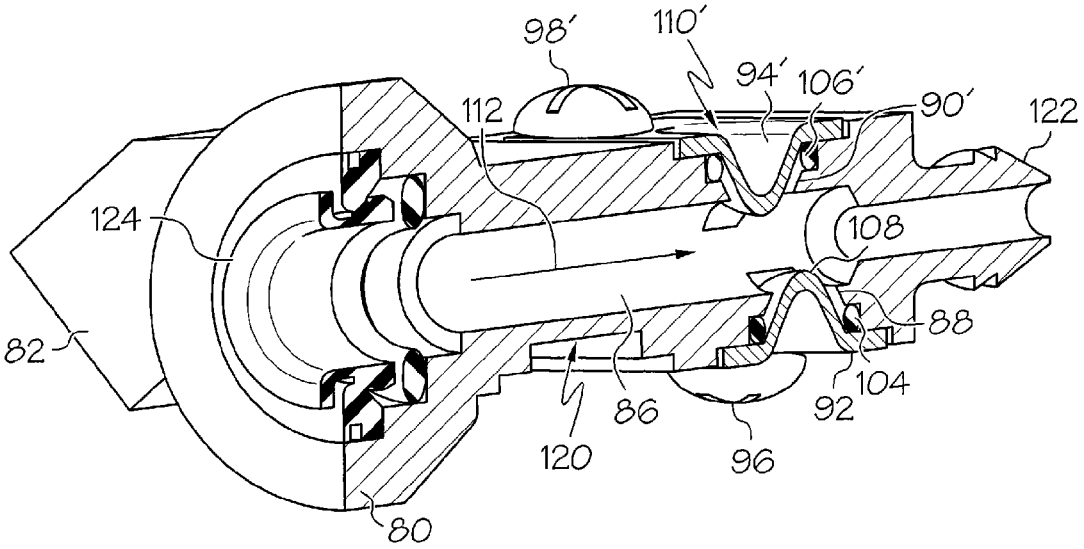

Referring now to FIGS. 3A and 3B, an alternative arrangement of a chemical sensor is shown, which may be considered or called an electrode opposed configuration because the electrodes are positioned in an opposed relationship to each other and the path of electrical contact between the two electrodes runs generally across the flow direction 112 of chemical through the housing passage 86. The sensor housing 80' is much the same as 80 in FIGS. 2A and 2B, except that the former open area 90 is closed off as shown at 120. An open area 90' is instead positioned across from the open area 88 and holds electrode 94' that is held in place by fasteners 98' with o-ring seal 106'. Notably, the illustrated electrode opposed configuration places the electrodes closer to each other than in the electrode parallel configuration. In this regard, in one implementation a distance between the electrodes (i.e., along the flow passage) in the electrode parallel configuration may be at least twice (e.g., at least three times or between two and six times) as large a distance between the electrodes (i.e., across the flow passage) in the electrode opposed configuration, though other variations are possible.

In the case of both sensor arrangements, one end of the sensor housing is configured with a tapered connecting part 122 that is suitable for insertion into rigid or flexible tubing (not shown) and the other end of the sensor housing is configured with a resilient connection insert 124 that can receive and hold a rigid or flexible tubing. Notably, the same mold tooling can be utilized to produce sensor housing 80 or sensor housing 80' through the selective use of inserts that define whether open area 90 or open area 90' is produced.

Figure 4:
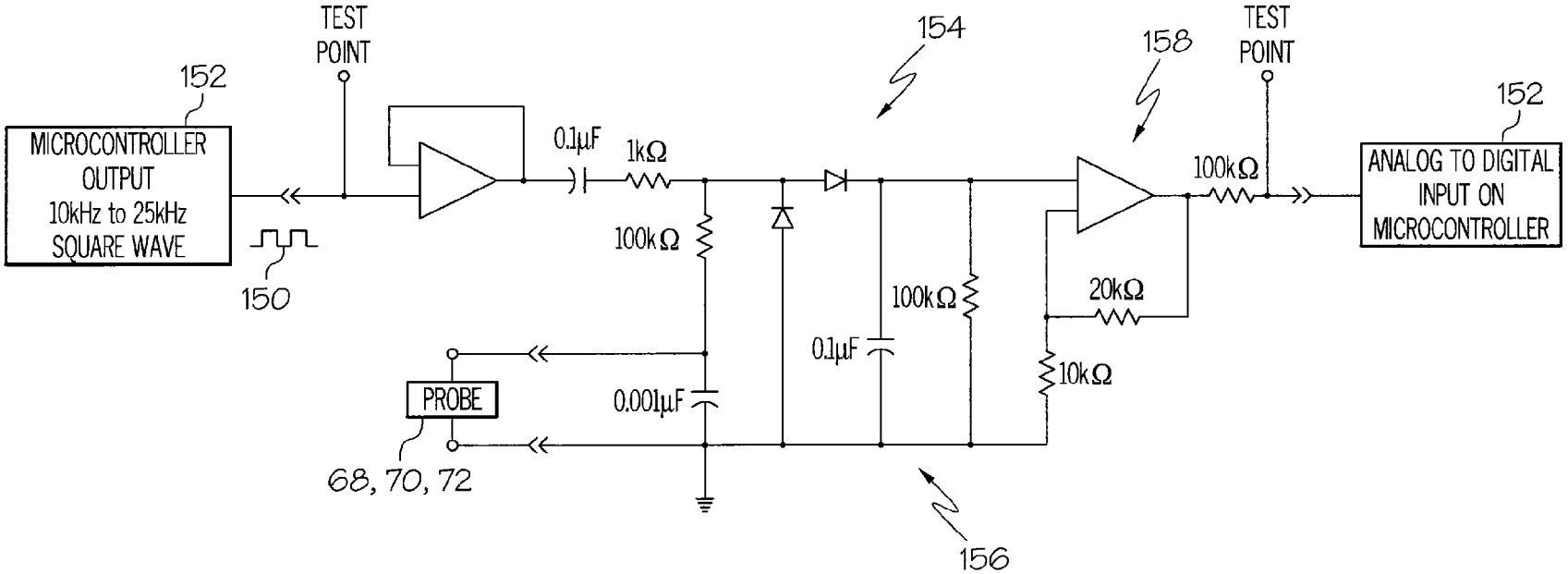
FIG. 4 shows a detection circuit.
Figure 5A:
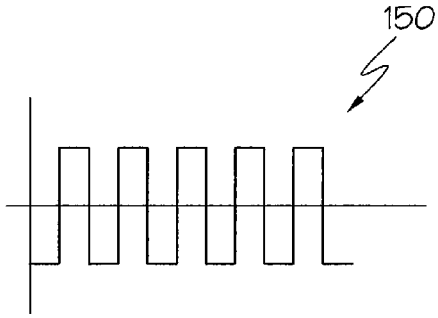
FIGS. 5A-5F depict exemplary waveforms/signals of the detection circuit.
Figure 5B:
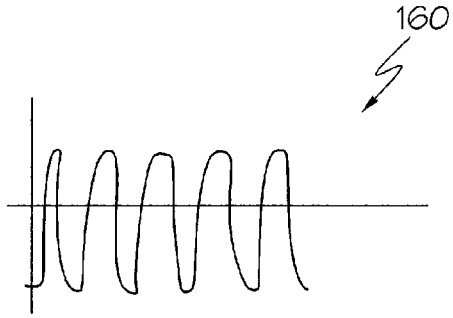
Figure 5C:
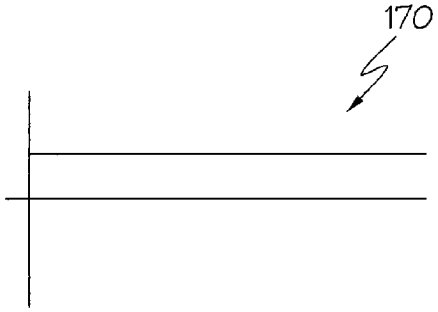
Figure 5D:
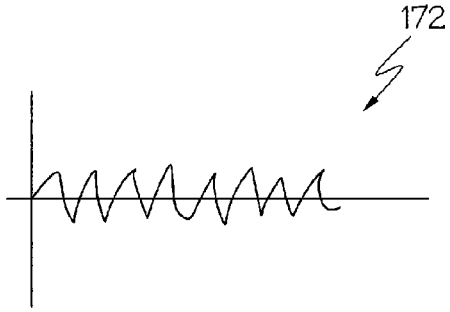
Figure 5E:
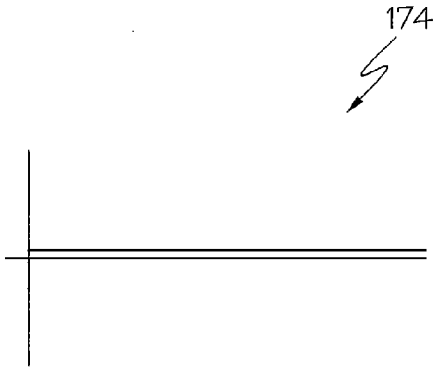
Figure 5F:
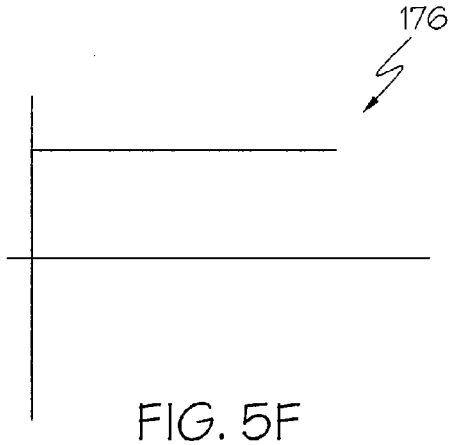

The electrodes of each sensor 68, 70, 72 are connected to a sensing circuit such as that shown in FIG. 4. In order to acquire feedback from the sensor, an excitation signal 150 is generated from the microcontroller 152 and applied to the chemical detection circuit 154. This excitation signal 150 may be a square wave with 50% duty cycle. 10 kHz may be the default frequency, although this can be adjusted from 5 kHz to 50 kHz (e.g., by accessing a service menu through the user interface 43).

When chemical comes in contact with both of the electrodes the sensor behaves as an impedance due to the properties of the chemical. The excitation signal is generated and the chemical attenuates the square wave. The attenuated square wave passes through a voltage doubler circuit 156 and an op amp buffer 158. The output voltage of the op amp is an analog voltage which ranges between 0-2.2 VDC. The output of the op amp is connected to one of the analog to digital ports of the microcontroller 152. An output voltage of 2.2 VDC indicates that chemical is not in contact with both electrodes of the sensor. A voltage of OV DC indicates that chemical is in contact with both electrodes and the chemical has a low impedance. In the presence of chemical, the voltage can vary between O VDC and 2.2 VDC depending on the impedance of the chemical.

The sensor and circuit provide a method of detecting presence or absence of a chemical in the chemical feed line by providing the flow through sensor in the chemical feed line, the sensor connected in a chemical detection circuit via its pair of electrodes. A periodic excitation signal is applied to the chemical detection circuit during the desired time for monitoring (e.g., when the pump associated with the chemical feed line is being operated). The sensor attenuates the periodic excitation signal according to impedance level of the chemical such that a level of attenuation varies inversely with impedance of the chemical. The sensor also causes little or no attenuation in the absence of the chemical. The attenuated excitation signal is converted to a DC voltage and is evaluated to determine the presence or absence of chemical. As described above, the periodic excitation signal may be a square wave signal and the evaluating step may involve comparing the DC voltage to a set threshold.

Each sensor and associated circuit may be suitably used to detect different chemical types. In this regard, the frequency of the applied excitation signal may be a variable program feature that is optimized for each chemical to provide the best detection. For example, a frequency of the periodic excitation signal may be defined according to one or more properties of the chemical (e.g., as determined by testing with the chemical) and/or the set threshold for evaluation purposes may be defined according to one or more properties of the chemical. In one implementation, the frequency and set threshold may be set by a service person with access to the control logic of the controller, based upon the machine operator's communication of the types of chemicals that will be used. In another implementation, the machine may automate this feature in accordance with stored information. Specifically, the warewash machine may include a user interface that enables the operator to identify the chemical being used (e.g., by presenting a list of chemical types from which the operator can select via a touch screen display or other input). The warewash machine then automatically defines the frequency and/or defines the set threshold according to the operator selection. For such purpose, the warewash machine controller stores multiple chemical types and, for each chemical type, a corresponding excitation signal frequency and/or set threshold.

FIGS. 5A to 5F represent, respectively, an exemplary square wave input signal 150, an output waveform 160 applied to the op amp 158 in the case of the presence of a high impedance chemical at both electrodes, an op amp output 170 in the case of the waveform 160, an output waveform 172 applied to the op amp 158 in the case of the presence of a low impedance chemical at both electrodes, an op amp output 174 in the case of the waveform 172 and an op amp output 176 resulting from chemical not contacting both electrodes.

Figure 6A:
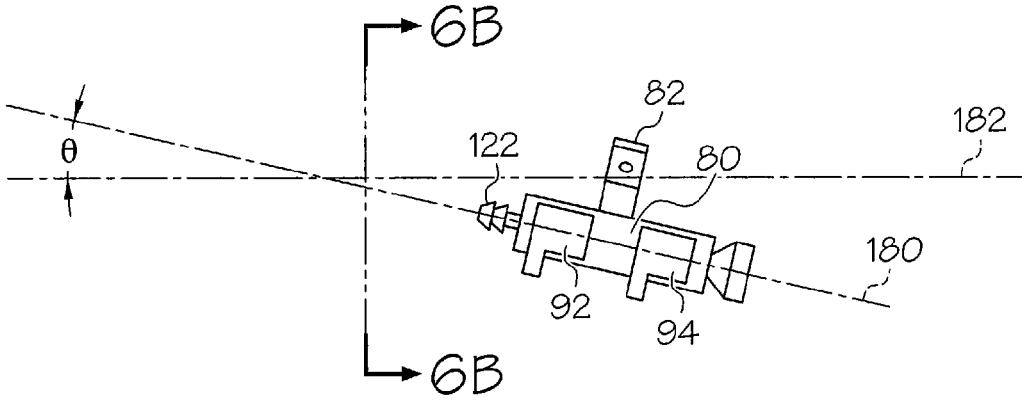
FIGS. 6A and 6B show an exemplary mount orientation for a sensor.
Figure 6B:
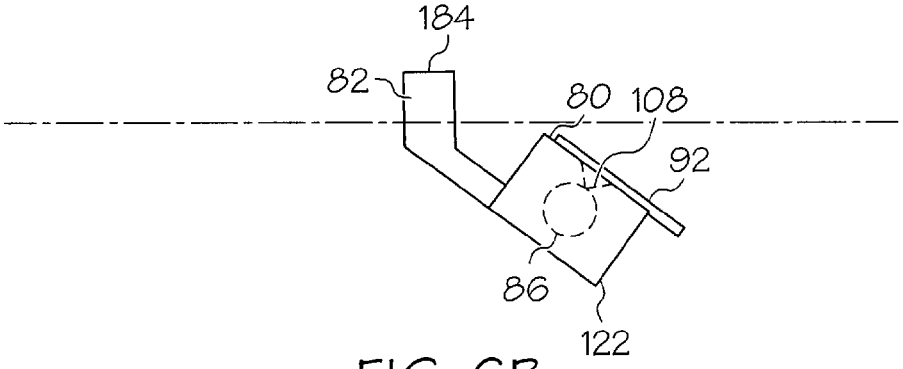

Referring to FIGS. 6A and 6B, favorable operation can be achieved by installing or mounting the chemical sensor in a defined orientation that is offset from both vertical and horizontal. Specifically, as seen in FIG. 6A an axis 180 parallel with the flow path through the sensor housing is offset from both vertical and horizontal 182, and as seen in FIG. 6B the sensor housing is tilted such that the electrodes are neither at the very top of the flow path nor at the very side edge of the flow path. The angle shown in FIG. 6A assures that the chemical drains out of the sensor when chemical is not being pumped, thus assuring that chemical does not sit in the sensor for extended periods of time (e.g., overnight). The orientation shown in FIG. 6B aids in limiting the trapping of air bubbles in the area of the electrodes. By way of example, angle θ may be between about 15 and 75 degrees. The electrodes are also not located at the very bottom of the flow path in the illustrated embodiment. As seen in FIG. 6B, a surface of the mount arm 82 may be configured such that when the surface is in the vertical orientation shown (e.g., as when mounted to a vertically extending surface or structure) the sensor housing includes the proper tilt to place the electrodes as desired.

It is to be clearly understood that the above description is intended by way of illustration and example only, is not intended to be taken by way of limitation, and that other changes and modifications are possible. For example, while the chemical detection sensor and circuit are described above primarily in the context of a batch-type warewasher, it is contemplated that the sensor, circuit and method could also be implemented in a conveyor-type warewasher (e.g., a warewasher in which wares are conveyed through a chamber that has a series of spray zones). Moreover, while a sensor construction utilizing electrodes attached by fasteners to the sensor housing is primarily described, it is recognized that in an alternative embodiment the electrodes could be molded-in to the housing. As another example, instead of converting the attenuated excitation signal to a DC voltage, the signal could be evaluated using a synchronized comparator.

What is claimed is:

1. A flow through chemical sensor, comprising:

a housing having a through passage along which chemical can flow, a sidewall of the housing having first and second openings that communicate with the through passage;

a first electrode mounted on the housing and aligned with the first opening, the first electrode of a plate configuration with a unitary depression that extends inward through the first opening and to at least a peripheral edge of the through passage such that an inwardly facing surface of the unitary depression can contact chemical flowing through the passage;

a second electrode mounted on the housing and aligned with the second opening, the second electrode of a plate configuration with a unitary depression that extends inward through the second opening and to at least the peripheral edge of the through passage such that an inwardly facing surface of the unitary depression of the second electrode can contact chemical flowing through the passage.

2. The flow through chemical sensor of claim 1 wherein:

a first o-ring is positioned between the housing and the first electrode and the first electrode is secured to the housing by way of a first fastener that provides a clamping force of the first electrode against the first o-ring for sealing, wherein the unitary depression of the first electrode extends through an opening of the first o-ring; and a second o-ring is positioned between the housing and the second electrode and the second electrode is secured to the housing by way of a second fastener that provides a clamping force of the second electrode against the second o-ring for sealing, wherein the unitary depression of the second electrode extends through an opening of the second o-ring.

3. The flow through chemical sensor of claim 2 wherein:

the first electrode includes a first lead arm configured for connection with a wire terminal; and the second electrode includes a second lead arm configured for connection with a wire terminal.

4. A warewash machine including the flow through chemical sensor of claim 1, wherein the flow through chemical sensor is located in a chemical feed line for delivering chemical directly or indirectly to a chamber of the machine.

5. The warewash machine of claim 4 wherein:

the flow through chemical sensor is connected in a chemical detection circuit via the first and second electrodes;

a controller of the machine is configured to apply a periodic excitation signal to the chemical detection circuit;

the chemical detection circuit is configured so that the flow through chemical sensor attenuates the periodic excitation signal according to impedance level of the chemical such that a level of attenuation varies inversely with impedance of the chemical and the sensor causes little or no attenuation in the absence of the chemical;

the controller further configured to evaluate the attenuated signal to determine the presence or absence of chemical and, in the absence of chemical to produce an operator alert.

6. The warewash machine of claim 5 wherein:

the warewash machine includes a user interface that enables an operator to identify the chemical being used and the controller is configured to automatically define a frequency of the applied periodic excitation signal according to operator selection of the chemical being used.

7. A flow through chemical sensor, comprising:

a housing having a through passage along which chemical can flow, a sidewall of the housing having first and second openings that communicate with the through passage;

a first electrode mounted on the housing and aligned with the first opening, the first electrode of a plate configuration with a unitary depression that extends inward through the first opening and to a peripheral edge of the through passage;

a second electrode mounted on the housing and aligned with the second opening, the second electrode of a plate configuration with a unitary depression that extends inward through the second opening and to the peripheral edge of the through passage;

a first o-ring is positioned between the housing and the first electrode and the first electrode is secured to the housing by way of a first fastener that provides a clamping force of the first electrode against the first o-ring for sealing, wherein the unitary depression of the first electrode extends through an opening of the first o-ring; and a second o-ring is positioned between the housing and the second electrode and the second electrode is secured to the housing by way of a second fastener that provides a clamping force of the second electrode against the second o-ring for sealing, wherein the unitary depression of the second electrode extends through an opening of the second o-ring.

8. The flow through chemical sensor of claim 7 wherein:

the first electrode includes a first lead arm configured for connection with a wire terminal; and the second electrode includes a second lead arm configured for connection with a wire terminal.

* * * * *